United States Patent [19]

Yano et al.

[11] Patent Number: 4,582,129

[45] Date of Patent: Apr. 15, 1986

[54] HEAT EXCHANGING SYSTEM

[75] Inventors: Nobuyuki Yano, Hirakata; Akira Aoki, Kadoma, both of Japan

[73] Assignee: Matsushita Electric Industrial Co., Ltd., Osaka, Japan

[21] Appl. No.: 531,893

[22] PCT Filed: Sep. 17, 1982

[86] PCT No.: PCT/JP82/00376

§ 371 Date: Aug. 2, 1983

§ 102(e) Date: Aug. 2, 1983

[87] PCT Pub. No.: WO83/02150

PCT Pub. Date: Jun. 23, 1983

[30] Foreign Application Priority Data

Dec. 7, 1981 [JP] Japan ..... 56-197482
Dec. 25, 1981 [JP] Japan ..... 56-213448

[51] Int. Cl.[4] ..... F28F 27/02

[52] U.S. Cl. ..... 165/97; 55/388; 55/269; 165/54

[58] Field of Search ..... 165/4, 97; 55/387, 388, 55/269

[56] References Cited

U.S. PATENT DOCUMENTS 2,788,065 4/1957 Lockman ..... 165/97
4,341,539 7/1982 Gidaspow et al. ..... 55/387
4,391,321 7/1983 Thunberg ..... 165/54
4,429,735 2/1984 Nomaguchi et al. ..... 165/DIG. 12

FOREIGN PATENT DOCUMENTS 2935695 9/1980 Fed. Rep. of Germany ..... 55/388

*Primary Examiner*—Albert W. Davis, Jr.
*Attorney, Agent, or Firm*—Wenderoth, Lind & Ponack

[57] ABSTRACT

A heat exchanging system including a heat exchanger element formed by stacking, in predetermined spaced relation, a plurality of thermally conductive partition plates, primary and secondary air streams being allowed to alternately flow through laminar spaces between the partition plates, and heat exchange being effected between the primary and secondary air streams while the primary and secondary air streams are cyclically switched. In accordance with different embodiments, the partition plates may be impermeable to moisture and be capable of accumulating moisture, (b) be moisture transmissive and hygroscopic, or (c) be impermeable to moisture and have no capability of accumulating moisture. In addition, in accordance with different embodiments, the direction of flow of the air streams can be such that (a) the alternate flows of both of the primary and secondary air streams are in the same direction, (b) the alternate flows of at least one of the primary and secondary air streams are in opposite directions, or (c) the alternate flows of both of the air streams are in the opposite directions. In this way, a high-efficiency total heat exchanging function or a high-efficiency sensible heat exchanging function can be obtained.

8 Claims, 19 Drawing Figures

HEAT EXCHANGING SYSTEM

FIELD OF TECHNOLOGY

This invention relates to a heat exchanging system applicable in an air conditioning ventilating device for the purpose of ventilating by heat exchange between air drawn from the outdoor air and air to be exhausted from the indoor air. More particularly, this invention relates to a heat exchanging system wherein heat transmissive partition plates are stacked in predetermined space relation to each other to form a laminated structure having laminar spaces defined between adjacent partition plates for the alternate flow of primary and secondary streams of air therethrough, the primary and secondary air streams being cyclically alternately passed through the laminar spaces.

BACKGROUND ART

Hitherto, as a plate-type heat exchanger element generally used in an air conditioning ventilating fan, a transmission-type total heat exchanging element wherein papers or the like which are permeable and moisture are used as partition plates and a sensible heat exchanging element wherein the partition plates are applied with a moisture-impermeable, heat conductive material such as metal or plastics is used. By allowing the drawn air and the exhaust air to flow simultaneously in respective predetermined directions through alternate laminar spaces each defined between the adjacent partition plates of the heat exchanging element, the total heat exchange, or the heat exchange reflecting temperature change (hereinafter referred to as "sensible heat exchange") takes place. In general, the total heat exchange efficiency is 55–60% while, in the case of the sensible heat exchanging element, the sensible heat exchange efficiency is about 65%.

SUMMARY OF THE INVENTION

This invention is intended to increase the heat exchange efficiency over that according to the prior art by allowing primary and secondary air to flow cyclically through alternate laminar spaces defined between adjacent partition plates which are the constituent elements of the heat exchanger element and which are heat transmissive and also to further increase the heat exchange efficiency by properly designing the direction of flow through each laminar space during ventilation. In addition, it is possible to provide a totally novel total heat exchanging system of high efficiency where the partition plates are impermeable to moisture and are hygroscopic.

DETAILED DESCRIPTION OF THE PREFERRED EMBODIMENTS

Figure 1:
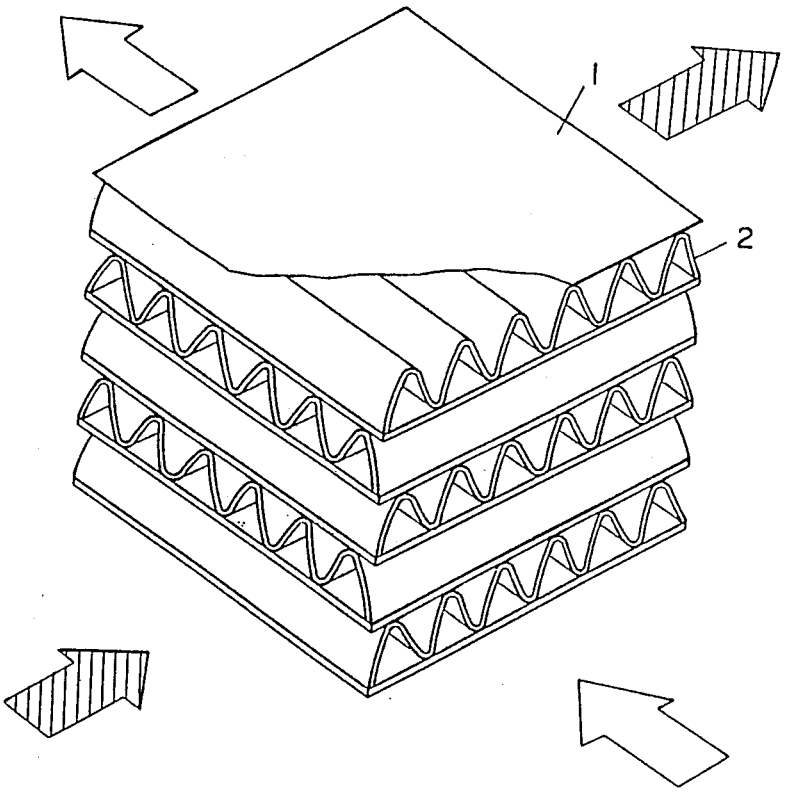
FIG. 1 is a fragmental perspective view, with a portion cut away, of a heat exchanging element forming a part of the heat exchanger device in one embodiment of this invention, FIGS. 2(*a*) and (*b*) and FIGS. 3(*a*) and (*b*) are sectional views of partition plates, FIGS. 4(*a*) to 4(*d*) are schematic diagrams of the embodiment for the measurement of the difference in heat exchange efficiency for different combinations of directions of flow of air streams when the air streams entering laminar spaces between the adjacent partition plates of the heat exchanging element are alternated.
Figure 2A:
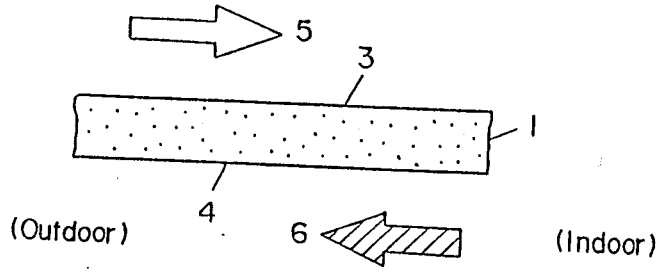
Figure 2B:
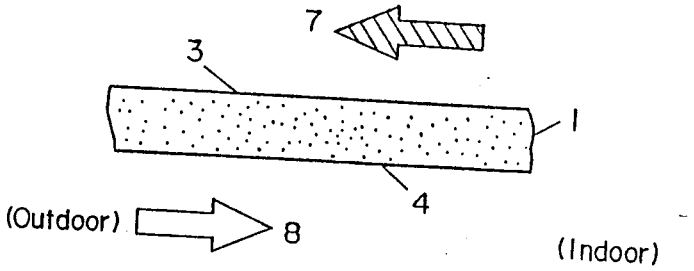
Figure 3A:
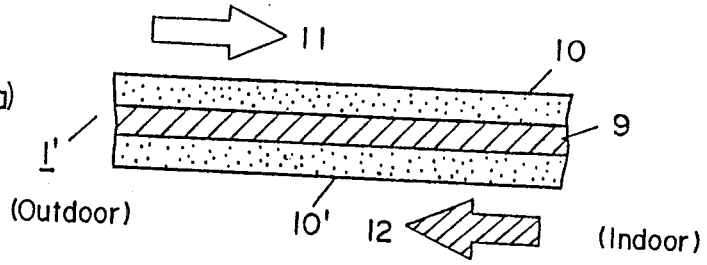
Figure 3B:
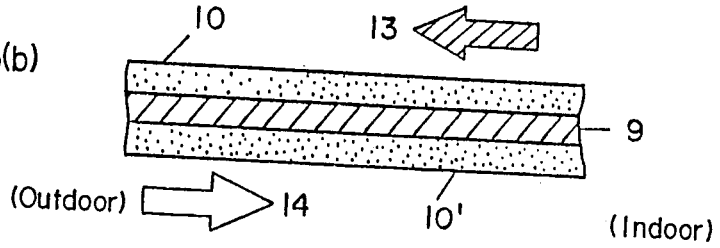
Figure 4A:
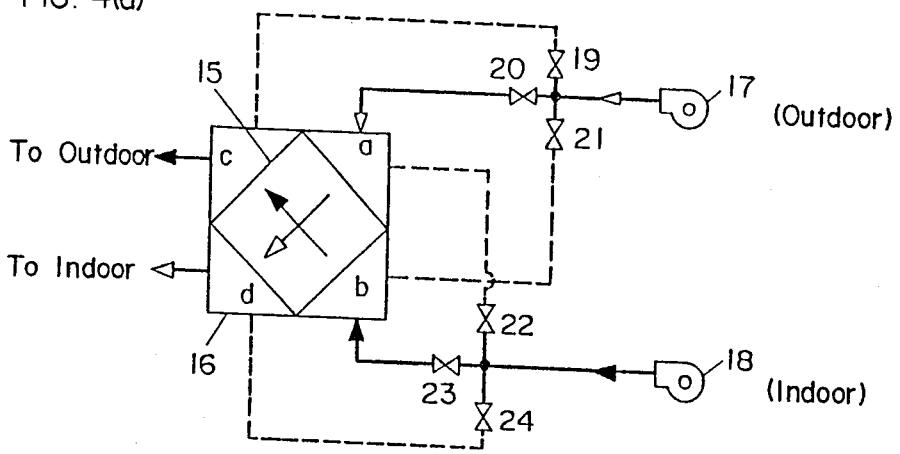
Figure 4B:
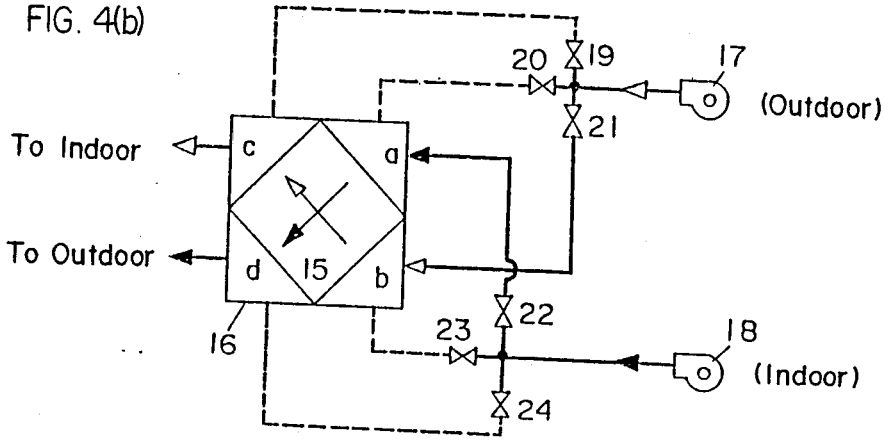
Figure 4C:
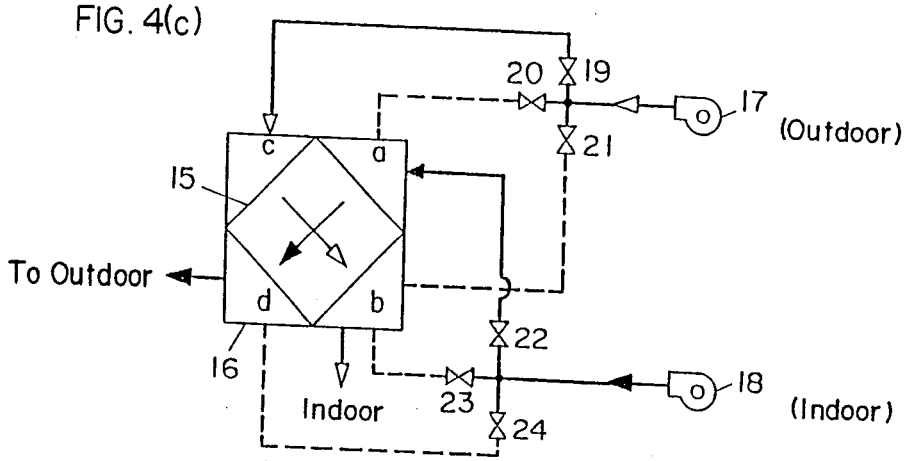
Figure 4D:
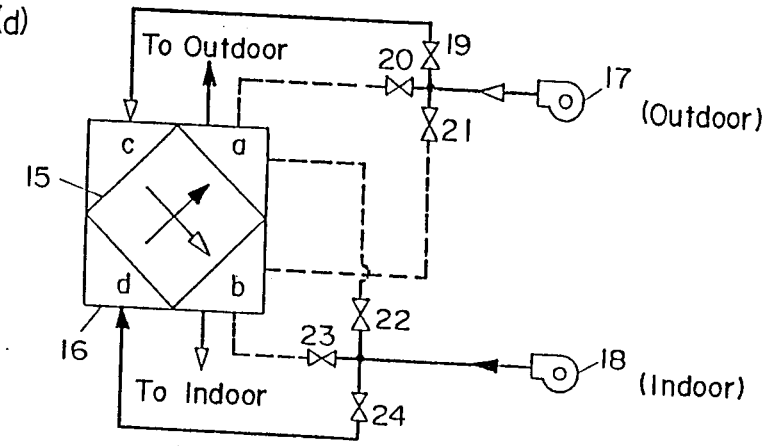

While the details of this invention will be described in connection with the embodiments thereof, the heat exchange system providing the basis for this invention will first be described. FIG. 1 illustrates a fragmental outer appearance of a laminate-type heat exchanging element used in one embodiment of this invention, wherein reference numeral 1 represents partition plates and reference numeral 2 represents spacer plates. FIGS. 2(*a*) and 2(*b*) are sectional views of a partition plate 1 using a flame-proofed kraft paper, illustrating an example wherein the partition plate 1 is heat transmissive and permeable to moisture. FIGS. 3(*a*) and 3(*b*) are sectional views of a partition plate 1' of the heat exchanging element which is made of an aluminum plate 9 having its opposite surfaces coated with hygroscopic aluminum oxide layers 10 and 10', respectively, illustrating an example wherein the partition plate is heat transmissive, but is impermeable to moisture and is also hygroscopic.

Referring to FIGS. 2(*a*) and 2(*b*) and to FIGS. 3(*a*) and 3(*b*), the directions of flow of air along upper and lower surfaces of the partition plate from the outdoor and indoor spaces (shown by the arrows 5 and 6 and the arrows 11 and 12), respectively, are shown as counter to each other for the purpose of illustration in the drawings, but in the embodiment they are perpendicular to each other. In principle, the counter flow results in the maximization of the heat exchange efficiency, but either or both can be employed as far as this invention is concerned. In addition, where the air stream from the outdoor space and the air stream from the indoor space are cyclically (at 1 minute intervals in this instance) exchanged (In the case where the conditions shown in FIGS. 2(*a*) and 2(*b*) or the conditions shown in FIGS. 3(*a*) and 3(*b*) are alternately established cyclically), the direction of flow of the air stream through each laminar space is reversed according to the exchange of the air streams, but although the direction of flow of air in the above instance affects the heat exchange efficiency, this is unrelated to the essence of the heat exchanging system of this invention. If the outdoor atmosphere during a summer of high temperature and high humidity is set at 26° C. and 50%, in the instance shown in FIGS. 2(*a*) and 2(*b*) and where air flows in directions shown by the arrows in FIG. 2(*a*), heat and moisture components of the air stream 5 directed from the outdoor space towards the indoor space are in part accumulated in the partition plate 1 and in part transferred from the surface 3 to the surface 4 across the partition plate 1 and into the air stream 6 from the surface 4 which is exposed to the air stream 6 from the indoor space, finally being exhausted to the outdoor space. In addition, adsorption heat evolved by the adsorption of moisture on the surface 3 of the partition plate 1 and desorption heat evolved by the desorption of moisture from the surface 4 (negative in this case because of heat absorption reaction) are in part accumulated in a similar manner and in part transferred from the side of the surface 3 to the side of the surface 4 across the partition plate 1. If the cycle changes subsequently with the air streams changed from the condition of FIG. 2(*a*) to a condition shown in FIG. 2(*b*), the heat and moisture components accumulated adjacent the surface 3 of the partition plate 1 are exhausted to the outdoor space carried by the air stream. Reference numeral 8 designates an air stream coming from the outdoor space. A merit of this system lies in that, by cyclically exchanging the air streams, not only can the enthalpy brought into the heat exchanging element from the outdoor space be exhausted back to the outdoor space through the partition plate 1, but also the enthalpy can be accumulated in the partition plate 1 as well as the spacer plate 2, which is in turn exhausted to the outdoor space when the air streams are exchanged, with the total heat exchange efficiency consequently markedly increased as compared with the prior art system.

Similarly, in the case of FIGS. 3(*a*) and 3(*b*), referring to FIG. 3(*a*), the temperature of the upper surface of the partition plate which contacts the air stream 11 of high temperature and high humidity flowing from the outdoor space into the indoor space, that is, the temperature of the hygroscopic layer 10, becomes high. In addition, since a moisture component in the outdoor air stream 11 is adsorbed on the surface of the hygroscopic layer 10 with adsorption heat and condensation heat being consequently generated, the temperature of the upper surface of the partition plate is further increased. On the other hand, not only is the lower surface 10' of the partition plate cooled in contact with the air stream 12 of low temperature and low humidity coming from the indoor space, but also desorption of the moisture component which has been adsorbed on 10' at the time of flow of the outdoor air stream during the previous cycle takes place, and therefore it is further cooled because of the endothermic reaction. By a series of these phenomena, a relatively large difference in temperature develops between the upper and lower surfaces 10 and 10' and, therefore, the amount of sensible heat transferred across the partition plate is increased to a value greater than that accomplished in a mere sensible heat exchanger which is not hygroscopic. Furthermore, a merit of this system lies in that, since the sensible heat brought from outdoor space and the adsorption heat generated from the surface of the partition plate which contacts the outdoor air stream are transferred across the partition plate onto the exhaust air stream 12 flowing from the indoor space so that they can be accumulated in the partition plate in addition to being exhausted to the outdoor space in readiness for the discharge thereof into the exhaust air stream 13 from the indoor space and then to the outdoor space during the next succeeding cycle, the transfer of the sensible heat from the outdoor space into the indoor space can be reduced with the sensible heat exchange efficiency consequently increased, as compared with the prior art transmission type. Reference numeral 14 designates an air stream flowing from the outdoor space. It is to be noted that, while in the prior art total heat exchanging system of the static transmission type the transfer of the moisture component is based on the moisture transmission phenomenon occurring in the partition plate, the system of the present invention differs from the prior art system in that it is based on the accumulation of the moisture component in the partition plate and the desorption thereof from the partition plate, and that the efficiency of moisture exchange can be increased as compared with the prior art method by shortening the cycle time interval for the exchange of the air streams. The total heat exchanging system in this instance is not only a novel system that has not been available hitherto, but also is featured in that it serves also as a sensible heat exchanger if the exchange of the air streams is interrupted.

Hereinafter, the case wherein an aluminum plate is used as an example wherein the partition plate has a high thermal conductivity, but has no moisture transmissivity and is not hygroscopic will be described. Even in this case, for a reason similar to that described hereinbefore, the system of this invention wherein the heat exchange is carried out while the air streams are exchanged has a higher efficiency than the prior art sensible heat exchanging method because, in addition to the mechanism of thermal conduction, the mechanism of heat accumulation participates in the sensible heat exchange.

As a matter of course, in both of these heat exchanging systems, the exchange of the air streams may not be performed cyclically, but may be effected before the capacity of the element to accumulate heat and moisture is saturated as detected by the use of a sensor or the like.

Hereinafter, a specific construction of the heat exchange device forming one embodiment of this invention will be described.

Figure 5:
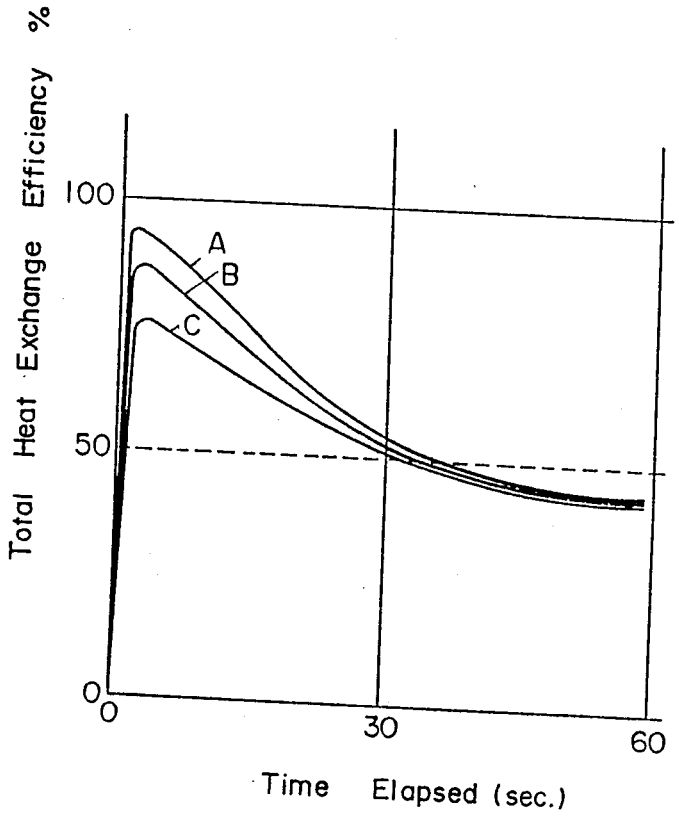
FIG. 5 is a diagram showing the results of the heat exchange efficiency measurements, FIGS. 6(*a*) to 6(*c*) are schematic diagrams showing a temperature distribution of the partition plate.

FIGS. 4(*a*) to 4(*d*) are schematic diagrams of air flow in an embodiment for a measurement to find the influence which the direction of flow of air may bring on the resultant heat exchanger efficiency in the event that the air streams flowing through the respective laminar spaces between each adjacent pair of partition plates are alternately exchanged, and FIG. 5 illustrates the results of the measurement. Reference numeral 15 designates a heat exchange element of such a construction as shown in FIG. 1 and of 200×200×250 mm in size. Reference numeral 16 designates a chamber, reference numeral 17 designates a fan for drawing air from the outdoor atmosphere, and reference numeral 18 designates a fan for drawing air from the indoor atmosphere, the flow rate across the heat exchanger element 15 being 2.5 $m^3$/min. in both directions. Exchange of air streams flowing through the heat exchanger element 15 is carried out by selectively opening and closing dampers 19 to 24. In the case where both of the directions of flow of the air streams remain the same even after the exchange, the condition of FIG. 4(*a*) and that of FIG. 4(*b*) are alternately established repeatedly. In such a case, the dampers 19 and 24 are allowed to be closed beforehand, and while the condition of FIG. 4(*a*) is maintained the dampers 20 and 23 should be opened while the dampers 21 and 22 should be closed. Thus, the air stream enters the heat exchanger element 15 from a position a of the chamber and is supplied to the indoor space from a position d. The air stream from the indoor space enters the heat exchanger element 15 from a position b and is exhausted to the outdoor space from a position c.

For the exchange of the air streams, as shown in FIG. 4(*b*), and dampers 20 and 23 should be closed while the dampers 21 and 22 should be opened. Thus, the air stream enters the heat exchanger element 15 from the position b of the chamber and is supplied to the indoor space from the position c. The air stream from the indoor space enters the heat exchanger element 15 from the position a and is exhausted to the outdoor space from the position d.

Thereafter, the conditions of FIGS. 4(*a*) and (*b*) are cyclically repeated.

In the case where one of the directions of flow of the air streams is reversed, the condition of FIG. 4(*a*) and that of FIG. 4(*c*) are to be alternately repeated, and the dampers 21 and 24 are allowed to be closed beforehand. As shown in FIG. 4(*a*) the dampers 20 and 23 and the dampers 19 and 24 are opened and closed, respectively, and subsequently the dampers 20 and 23 and the dampers 19 and 22 are closed and opened, respectively, as shown in FIG. 4(*c*) for the exchange of the air streams.

In the case where both of the directions of flow of the air streams are reversed, the condition of FIG. 4(*a*) and that of FIG. 4(*d*) are to be alternately repeated. That is, the dampers 21 and 22 are allowed to be closed beforehand whereas, as shown in FIG. 4(*a*), the dampers 20 and 23 are opened, the dampers 20 and 23 are closed, and the dampers 19 and 24 are opened. The measurement of the temperature and the humidity of entrances and exits of the heat exchanger element 15 was carried out by installing temperature sensors and humidity sensors at the illustrated positions a, b, c and d and causing change thereof to be recorded by a recorder. The humidity sensors used are of a type utilizing change in the electrostatic capacitance of tantalum and so high in response as to attain 95% of the equilibrium value in a few seconds after the exchange of the atmosphere streams.

Such heat exchange efficiency measuring devices were installed between adjoining rooms of constant temperature and constant humidity which were adjusted to conditions of temperature and humidity of the indoor atmosphere (26° C., 50%) and the outdoor atmosphere (33° C., 70%), respectively, and the heat exchange was effected by alternately cyclically exchanging at a cycle of 1 minute the air streams flowing into the heat exchanger element 15.

FIG. 5 illustrates change of the total heat exchange efficiency plotted on the abscissa relative to the time elapsed subsequent to the switching of the dampers, which efficiency was obtained when an aluminum plate having a hygroscopic aluminum oxide layer coated on the surface thereof was used as the heat exchanger element 15. In FIG. 5, reference letter A designates the case wherein both of the directions of flow of the air streams did not change when the air streams had alternately been switched, reference letter B designates the case wherein one of the directions was reversed, and reference letter C designates the case wherein both of the directions were reversed. As is clear from these results, in the heat exchanging system wherein the air streams are exchanged, the heat exchange efficiency exhibited highest in the system wherein both directions do not change and lowest in the system wherein both directions are reversed. However, the case wherein both of the directions are reversed has not only the merit that the pile-up of dusts at the entrances of the element can be minimized but also the merit that a relatively simple mechanism such as rotation of a propeller fan in both directions can be employed for effecting the exchange of the air streams. On the other hand, even where the heat exchanger element 15 employs partition plates which are thermally conductive and moisture transmissive and also where the heat exchanger element 16 employs partition plates which are thermally conductive moisture impermeable and are non-hygroscopic, results similar to that obtained with respect to the directions of flow of the air streams are obtained.

Figure 6A:
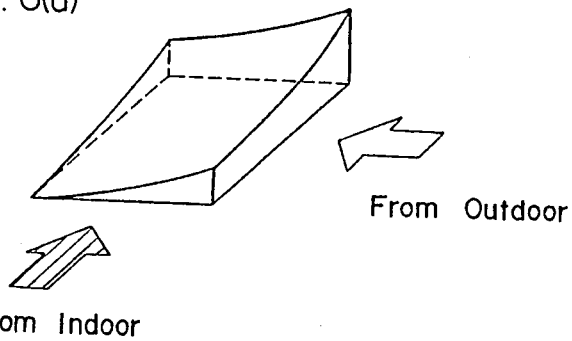
Figure 6B:
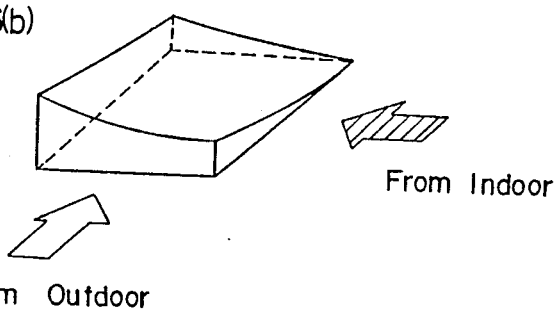
Figure 6C:
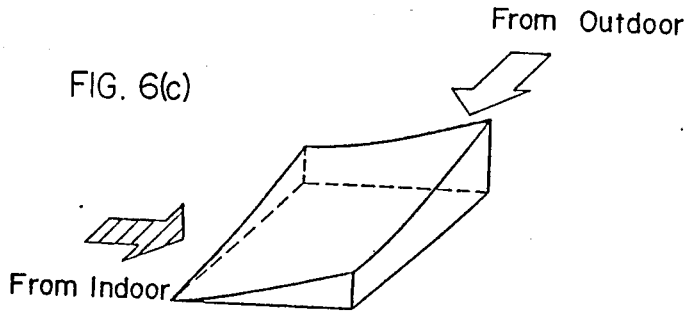

The above described phenomenon can be explained with the aid of the schematic illustrations of FIGS. 6(*a*) to 6(*c*). In the case where the directions of flow of the air streams through the respective laminar spaces between the partition plates do not change even if the air streams are switched, accumulation of heat in the heat exchanger element and dissipation of heat from the heat exchanger element are particularly responsible for an improvement of the efficiency and, therefore, the effectiveness of the system. The distribution of temperature on the partition plate in the state of equilibrium during each cycle will be discussed. In terms of a three-dimensional model wherein temperature is measured along the ordinate axis, the temperature distribution will be such as is shown in FIGS. 6(*a*) and 6(*b*). On the other hand, in the case where the cycle changes before the state of equilibrium is reached, the temperature distribution in the partition plate will be such as to reciprocately pass over an intermediate stage between FIGS. 6(*a*) and 6(*b*) as a result of the change in cycle. On the other hand, in the case where the air streams are switched in such a direction that both of the directions of flow of the air streams through the laminar spaces can be reversed, the temperature distribution in the partition plate will be such as to reciprocately pass over an intermediate stage between FIGS. 6(*a*) and 6(*c*) as a result of the change in cycle. From these figures, it will readily be seen that the change from FIG. 6(*a*) to FIG. 6(*b*) results in the greater variation of the amount of heat accumulated in the partition plate than the change from FIG. 6(*a*) to FIG. 6(*c*). This means that the greater variation of the amount of heat accumulated in the partition plate resulting from the change in cycle can be obtained in the case where the change in cycle does not result in change of both of the directions of flow of the air streams than in the case where both of these directions are reversed. This phenomenon appears to be associated with the difference in heat exchange efficiency resulting from the difference in direction of flow of the air streams. On the other hand, where the partition plate has a capability of accumulating a moisture component, the distribution of the moisture content adsorbed on the partition plate is more complicated than the temperature distribution and is unknown.

Figure 7:
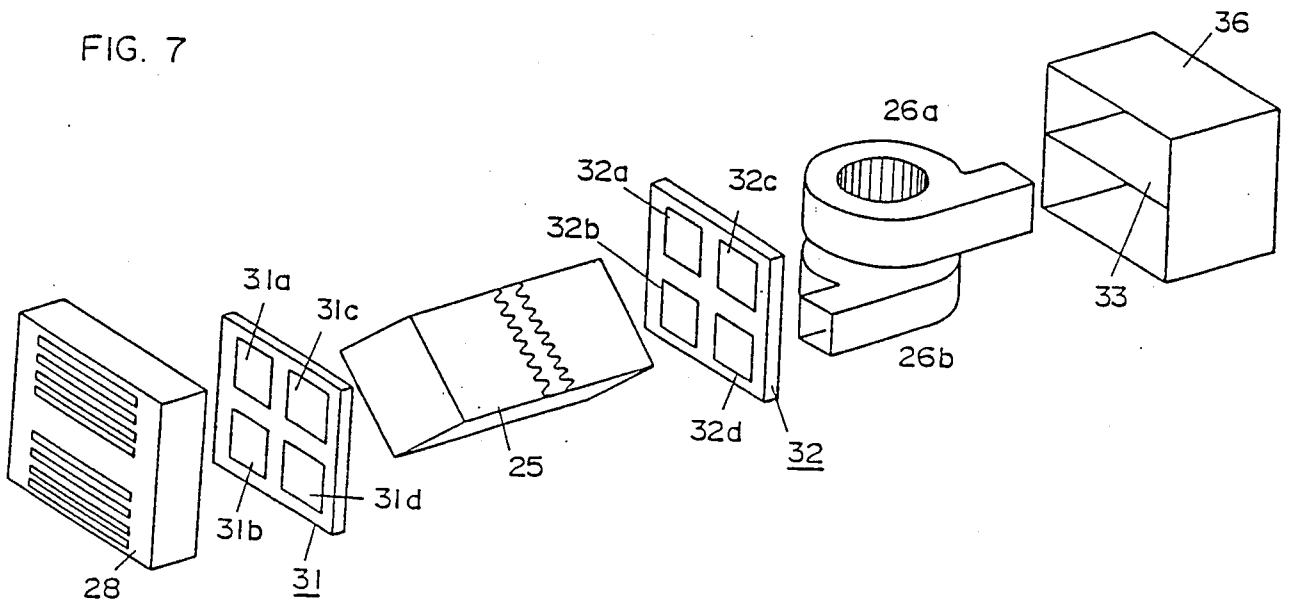
FIGS. 7 and 8 are exploded and cross-sectional views, respectively, of the total heat exchanger device in the embodiment of this invention, FIGS. 9(*a*) and 9(*b*) and FIGS. 10(*a*) and 10(*b*) are schematic cross-sectional views of an air conditioning ventilating fan according to different embodiments of this invention, respectively.
Figure 8:
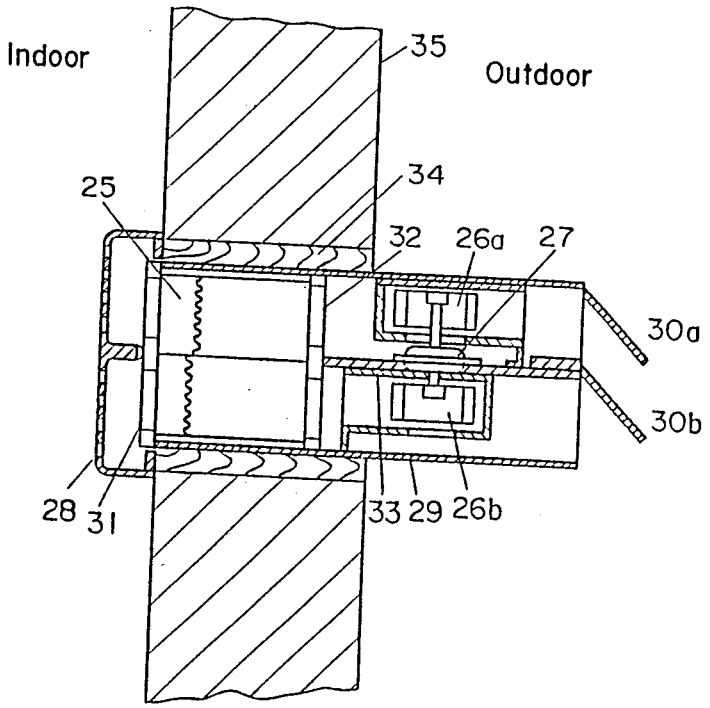

FIG. 7 is an exploded view showing an embodiment of manufacture of an air conditioning ventilating fan of a system wherein both of the directions of flow of the air streams does not change when the air streams are switched, and FIG. 8 is a cross-sectional view thereof. In the figures, reference numeral 25 designates a total heat exchanger element, the partition plates being each in the form of an aluminum plate coated with hygroscopic aluminum oxide. Reference numeral 26*a* designates a fan for exhausting indoor air, reference numeral 26*b* designates a fan for drawing an outdoor air, and reference numeral 27 designates a fan drive motor. Reference numeral 28 designates a louver formed in a front panel, reference numeral 29 designates a frame, and reference numerals 30*a* and 30*b* designate respective shutters which are closed during when the system is inoperative. The switching of the air streams flowing through the interior of the total heat exchanger element 25 is carried out by selectively opening and closing slide shutters 31*a*, 31*b*, 31*c*, 31*d*, 32*a*, 32*b*, 32*c* and 32*d* fitted to shutter support frames 31 and 32 positioned respectively frontwardly and rearwardly of the total heat exchanger element 25. During normal operation, the shutters 31*a* and 31*b* and the shutters 32*c* and 32*d* are opened and the shutters 31*c* and 31*d* and the shutters 32*a* and 32*b* are closed, whereas after the cycle has changed, the shutters shift with the consequence that the shutters 31*a* and 31*b* and the shutters 32*c* and 32*d* are closed and the shutters 31*c* and 31*d* and the shutters 32*a* and 32*b* are opened, thereby switching the air streams entering the total heat exchanger element 25. However, the directions of flow of the air streams remain the same before and after the change in cycle. Reference numeral 33 designates a partition plate, reference numeral 34 designates a wood frame, reference numeral 35 designates a wall, and reference numeral 36 designates a frame.

Figure 9A:
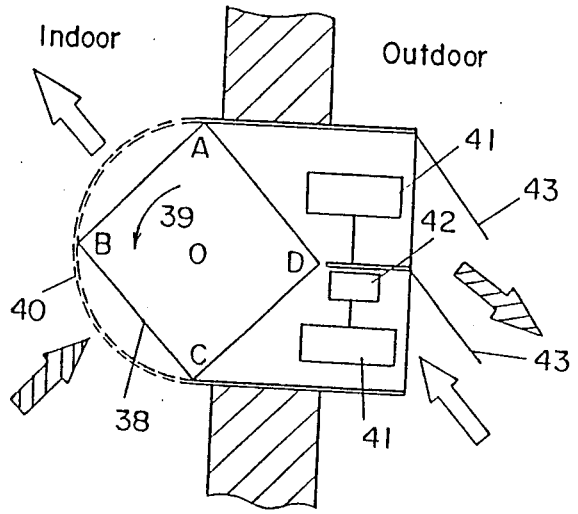
Figure 9B:
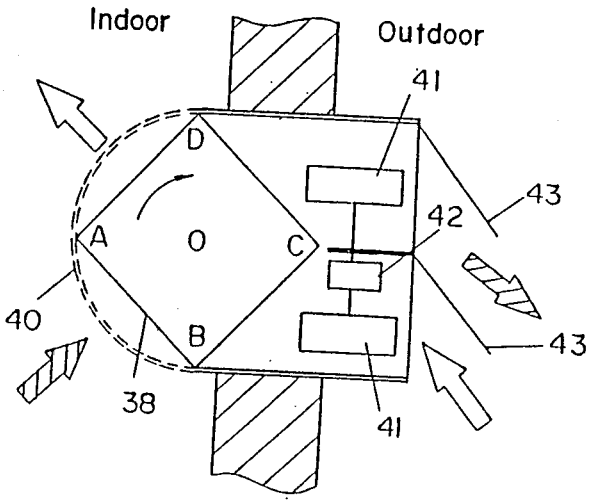

FIGS. 9(*a*) and (*b*) illustrate an embodiment of an air conditioning ventilating fan of a type wherein, when the air streams are switched, only one of the directions of flow of the air stream is reversed. In these reference numeral 38 designates a heat exchanger element of the type referred to above, capable of swinging 90° C. about the 0 point in the direction shown by the arrow 39 thereby to cyclically repeat the conditions of FIGS. 9(*a*) and 9(*b*) for the purpose of exchanging the air streams flowing through the heat exchanger element. It is to be noted that, instead of a system wherein the 90° swinging is repeated about the 0 point, a system wherein the heat exchanger element rotates 90° stepwisely in a predetermined direction can be employed. Reference numeral 40 designates a front panel louver, reference numeral 41 designates a blower, reference numeral designates a fan drive motor, and reference numeral 43 designates.

Figure 10A:
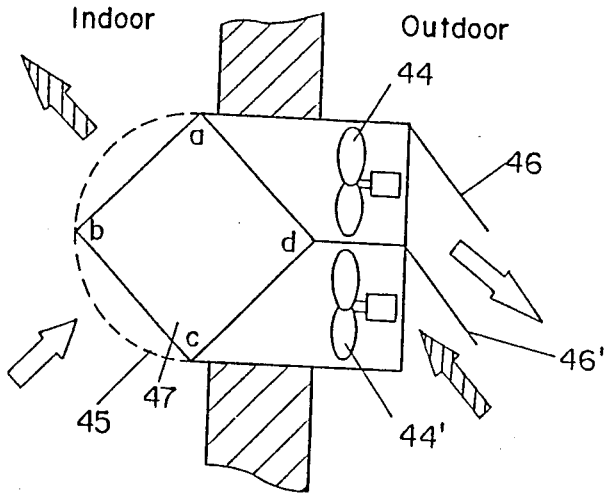
Figure 10B:
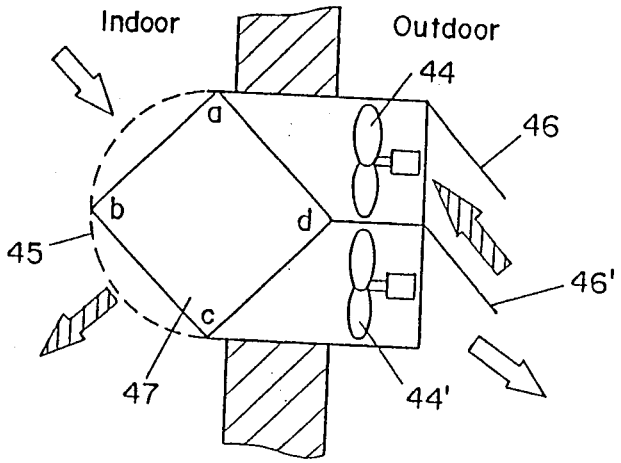

FIGS. 10(*a*) and 10(*b*) are schematic diagrams showing an embodiment of an air conditioning ventilating fan fabricated by the use of this system. In these figures, reference numeral 47 designates a total heat exchanger element, and reference numerals 44 and 44' designate propeller fans. Reference numeral 45 designates a louver in said panel. Reference numerals 46 and 46' designate shutters which are closed when the system is inoperative. In this instance, the cyclical exchange of the air streams flowing through the interior of the heat exchanger element is effected by reversing both of the directions of rotation of the fans 44 and 44'. In this instance, the total heat exchanger element 47 is always held stationary and, by the reversion of the directions of rotation of the fans 44 and 44', the directions of flow of the air streams cyclically repeat the conditions of FIGS. 10(*a*) and 10(*b*).

Industrial Applicability

As hereinbefore described, with the heat exchanging system of this invention, a heat exchanging function of high efficiency can be obtained. In particular, where the partition plates of the heat exchanger element are moisture transmissive, a total heat exchanging function of high efficiency can be obtained. Moreover, where the partition plates impermeable to moisture and are hygroscopic, a novel total heat exchanging system which has not hitherto been available can be realized. In addition, where no changes in directions of flow of the air streams through the laminar spaces in the heat exchanger element take place even when the cycle changes periodically, the amount of heat accumulated in the heat exchanger element can be further increased, thereby increasing the heat exchange efficiency. Yet, where both of the directions of flow of the air streams are reversed, adherence of dusts to the entrances of the heat exchanger element can be minimized. Furthermore, by increasing the hygroscopic property of the spacer plates, the capacity of the plates to accumulate moisture from the air can be increased and, therefore, the exchange efficiency for the moisture component can be increased.

What is claimed is:

1. A heat exchanging system comprising:

a heat exchanger element including a plurality of spaced, stacked, thermally conductive and adsorptive, moisture adsorptive and impermeable partition plates having alternating first and second laminar spaces therebetween for alternate passage therethrough of primary and secondary air streams; and means for alternatingly driving said primary air streams through said first laminar spaces in a first direction while driving said secondary air streams through said second laminar spaces in a second direction, and driving said primary air streams through said second laminar spaces in a third direction while driving said secondary air streams through said first laminar spaces in a fourth direction, to effect heat exchange between said primary and secondary air streams.

2. A heat exchanging system as in claim 1, wherein said first and second directions are respectively the same as said fourth and third directions.

3. A heat exchanging system as in claim 1, wherein said first and second directions are respectively opposite said fourth and third directions.

4. A heat exchanging system as in claim 1, wherein said driving means includes means for driving said primary and secondary streams in a same direction in at least one of said first laminar spaces and said second laminar spaces.

5. A heat exchanging system as in claim 1, wherein said driving means includes means for driving said first and second air streams in opposite directions in at least one of said first laminar spaces and said second laminar spaces.

6. A heat exchanging system as in claim 1, further comprising hygroscopic spacer plates disposed between adjacent ones of said plurality of partition plates.

7. A heat exchanging system as in claim 4, further comprising hygroscopic spacer plates disposed between adjacent ones of said plurality of partition plates.

8. A heat exchanging system as in claim 1, wherein said partition plates comprise aluminum plates coated with hygroscopic aluminum oxide layers.

* * * * *